US012167819B2

(12) United States Patent
Ebrahimi Afrouzi

(10) Patent No.: US 12,167,819 B2
(45) Date of Patent: Dec. 17, 2024

(54) SIDE BRUSH WITH ELONGATED SOFT BRISTLES FOR ROBOTIC CLEANERS

(71) Applicant: Ali Ebrahimi Afrouzi, Henderson, NV (US)

(72) Inventor: Ali Ebrahimi Afrouzi, Henderson, NV (US)

(73) Assignee: AI Incorporated, Toronto (CA)

( * ) Notice: Subject to any disclaimer, the term of this patent is extended or adjusted under 35 U.S.C. 154(b) by 0 days.

(21) Appl. No.: 18/394,515

(22) Filed: Dec. 22, 2023

(65) Prior Publication Data

US 2024/0122432 A1 Apr. 18, 2024

Related U.S. Application Data

(63) Continuation of application No. 17/827,919, filed on May 30, 2022, now Pat. No. 11,882,969, which is a continuation of application No. 16/203,385, filed on Nov. 28, 2018, now abandoned.

(60) Provisional application No. 62/591,214, filed on Nov. 28, 2017.

(51) Int. Cl.
*A47L 11/40* (2006.01)

(52) U.S. Cl.
CPC ..... *A47L 11/4036* (2013.01); *A47L 2201/00* (2013.01)

(58) Field of Classification Search
CPC ..... A47L 2201/04
See application file for complete search history.

(56) References Cited

U.S. PATENT DOCUMENTS

2016/0027207 A1* 1/2016 Hillen ..... G05D 1/0016 348/207.1

* cited by examiner

*Primary Examiner* — Andrew A Horton

(57) ABSTRACT

A robotic cleaner executing operations such as capturing data indicative of locations of objects in a workspace through which the robot moves; generating or updating a map of at least a part of the workspace based on at least the data; and navigating based on the map or an updated map of the workspace. The robotic cleaner may include a side brush with a main body with at least one attachment point and at least one bundle of bristles attached to the at least one attachment point of the main body.

20 Claims, 4 Drawing Sheets

SIDE BRUSH WITH ELONGATED SOFT BRISTLES FOR ROBOTIC CLEANERS

CROSS-REFERENCE TO RELATED APPLICATIONS

This application is a Continuation of U.S. Non-Provisional Patent application Ser. No. 17/827,919, filed May 30, 2022, which is a Continuation of U.S. Non-Provisional patent application Ser. No. 16/203,385, filed Nov. 28, 2018, which claims the benefit of Provisional Patent Application No. 62/591,214, filed Nov. 28, 2017, each of which is hereby incorporated by reference in its entirety.

In this patent, certain U.S. patents, U.S. patent applications, or other materials (e.g., articles) have been incorporated by reference. Specifically, U.S. patent application Ser. Nos. 16/024,263, 15/924,176, 15/647,472, 62/527,261, 62/544,273, 62/364,517, 16/051,328, 15/449,660, 15/272,752, and 15/949,708 are hereby incorporated by reference in their entirety. The text of such U.S. patents, U.S. patent applications, and other materials is, however, only incorporated by reference to the extent that no conflict exists between such material and the statements and drawings set forth herein. In the event of such conflict, the text of the present document governs, and terms in this document should not be given a narrower reading in virtue of the way in which those terms are used in other materials incorporated by reference.

FIELD OF THE DISCLOSURE

The present disclosure relates to robotic cleaners in general, and more specifically to side brushes of robotic cleaners.

BACKGROUND

A side brush may be considered an essential component of a robotic cleaner as it can sweep dust and debris that is out of reach of the main brush in front of the robotic cleaner such that the main brush is able to better clean the dust and debris. Sometimes the operation of a side brush is disrupted due to entanglement with obstructions in the working environment, disabling a component of the robotic cleaner. For example, cords, cables, carpet and other types of obstructions on the surface of the working environment can become entangled with a side brush of a robotic cleaner as it operates within the working environment if, for instance, the robotic cleaner attempts to overcome the obstruction by driving over it. When a spinning side brush encounters an obstruction (e.g., cord, cable, or carpet), the obstruction may become entangled with the side brush by, for example, increasingly wrapping around the side brush as the side brush continues to spin or the side brush may be lodged in the obstruction (e.g., lodged beneath a carpet). In some cases, the obstruction becomes entangled with the side brush to the extent that it prevents the side brush from spinning, thereby debilitating the side brush. In some instances, the robotic cleaner may be prevented from moving forward if the entangled obstruction becomes taut (e.g., by a fixed cord or cable with limited length) or the side brush may be lodged to the degree that the robotic cleaner cannot move, thereby disabling the robotic cleaner from operating. Methods for preventing a side brush from becoming entangled or lodged with obstructions in the working environment are therefore essential to the functionality and operation of the robotic cleaner.

None of the preceding discussion should be taken as a disclaimer of any of the described techniques, as the present approach may be used in combination with these other techniques in some embodiments.

SUMMARY

The following presents a simplified summary of some embodiments of the present techniques. This summary is not an extensive overview of the invention. It is not intended to limit the invention to embodiments having any described elements or to delineate the scope of the invention. Its sole purpose is to present some embodiments of the invention.

Some aspects include a method for cleaning a workspace by a robot, including: capturing, with at least one sensor disposed on the robot, data indicative of locations of objects in a workspace through which the robot moves; generating or updating, with a processor of the robot, a map of at least a part of the workspace based on at least the data; navigating, with the processor, the robot based on the map or an updated map of the workspace; displaying, with a software application executed on a user computing device paired with the robot, each of: the map, a status of the robot, a battery level of the robot, and progress statistics of a robotic operation in execution or executed by the robot; and receiving, with the software application, at least one input designating each of: a cleaning schedule, a subarea of the workspace, a name for the subarea of the workspace, the robotic operation to be executed by the robot within at least one area of the workspace or the entire workspace, and settings to be applied within at least one subarea of the workspace or the entire workspace; wherein: the robot includes at least one brush; and the robotic operation includes at least one of: mopping and vacuuming.

Some aspects provide a system for cleaning a workspace by a robot, including: a robot, including: at least one brush; at least one sensor; a processor; and computer-readable memory storing instructions that when executed by the processor effectuates operations including: capturing, with the at least one sensor, data indicative of locations of objects in a workspace through which the robot moves; generating or updating, with the processor, a map of at least a part of the workspace based on at least the data; and navigating, with the processor, the robot based on the map or an updated map of the workspace; and a software application executed on a user computing device paired with the robot configured to: display each of: the map, a status of the robot, a battery level of the robot, and progress statistics of a robotic operation in execution or executed by the robot; and receive at least one input designating each of: a subarea of the workspace, a name for the subarea of the workspace, the robotic operation to be executed by the robot within at least one area of the workspace or the entire workspace, settings to be applied within at least one subarea of the workspace or the entire workspace, and a modification to the map indicating an area within the workspace the robot is to avoid; wherein: the robotic operation includes at least one of: mopping and vacuuming; the settings include at least a cleaning intensity; and the cleaning intensity includes a suction power level.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for read-ability and instructional purposes and may not have been selected to delineate or circumscribe the inventive subject matter.

BRIEF DESCRIPTION OF THE DRAWINGS

Non-limiting and non-exhaustive features of the present invention are described and depicted with reference to the following figures, wherein like reference numerals refer to like parts throughout the various figures.

DETAILED DESCRIPTION OF SOME EMBODIMENTS

Figure 1A:
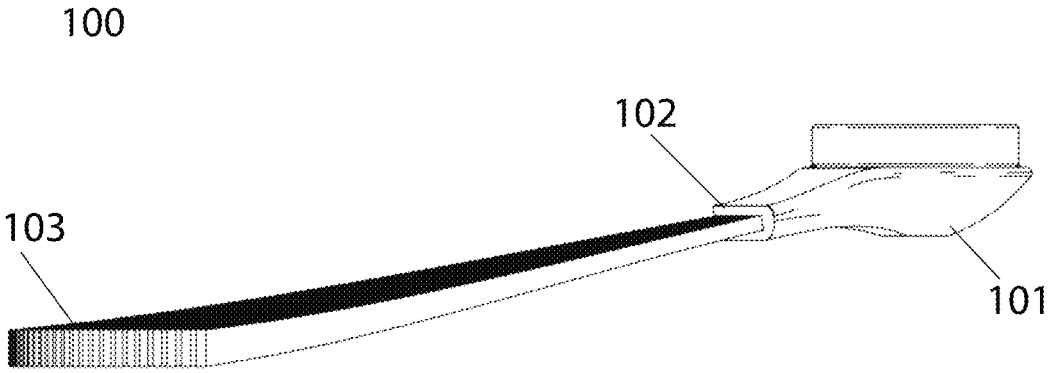
FIGS. 1A and 1B illustrate examples of a side brush with long soft bristles, embodying some features of the present inventions.

The present invention will now be described in detail with reference to a few embodiments thereof as illustrated in the accompanying drawings. In the following description, numerous specific details are set forth in order to provide a thorough understanding of the present inventions. It will be apparent, however, to one skilled in the art, that the embodiments described may be practiced without some or all of these specific details. In other instances, well known process steps and/or structures have not been described in detail in order to not unnecessarily obscure the embodiments presented. Further, it should be emphasized that several inventive techniques are described, and embodiments are not limited to systems implanting all of those techniques, as various cost and engineering trade-offs may warrant systems that only afford a subset of the benefits described herein or that will be apparent to one of ordinary skill in the art.

Although various methods and techniques are described herein, it should be kept in mind that the present techniques may also be implemented as articles of manufacture that include a computer readable medium (a term which as used herein broadly refers to a single medium storing all instructions or media in use cases where different subsets of instructions are stored on different media) on which computer-readable instructions for carrying out embodiments of the inventive methods or technique are stored. The computer readable medium may include, for example, semiconductor, magnetic, opto-magnetic, optical, or other forms of computer readable medium for storing computer readable code. Further, the inventions may also be embodied as apparatuses. Such apparatus may include circuits, dedicated and/or programmable, to carry out tasks pertaining to embodiments of the invention. Examples of such apparatus may include a specialized computer and/or a dedicated computing device when appropriately programmed and may include a combination of a computer/computing device and dedicated/programmable circuits adapted for the various tasks pertaining to embodiments of the inventions.

Some embodiments provide a side brush of a robotic cleaner with long soft bristles. The bristles are long and soft to prevent them from becoming entangled or lodged with obstructions in the environment (e.g., cords or carpet) that the robotic cleaner may encounter during operation. When side brush bristles encounter an obstruction, such as an electrical cord or carpet, the long soft bristles usually sweep over the obstruction, avoiding entanglement or lodging of the side brush with the obstructions and any disruption in the operation of the robotic cleaner. Generally, long soft bristles with a lower stiffness are flexible and therefore are less likely to become entangled or lodged with an obstruction.

In some embodiments, the side brush comprises a main body with at least one attachment point and at least one bundle of bristles that is attached on one end to the at least one attachment point of the main body. In some embodiments, the at least one attachment point of the main body is provided at the end of at least one protrusion of the main body (e.g., a nub, a rectangular rod, a circular rod, or any other shape or form protruding out from a main core of the main body). In some embodiments, the main body of the side brush attaches to the chassis of the robotic cleaner by, for example, a snap button, screws, glue, sliding into a socket, or by other means. In some embodiments, the side brush is electrically coupled to and powered by a motor that may be controlled by one or more processors of the robotic device. In some embodiments, the chassis of the robotic cleaner includes an opening in the bottom such that the motor housed within the chassis of the robotic cleaner may be connected to the side brush that is external to the chassis. In some embodiments, the side brush is connected to a rotating element of the motor by, for example, a snap button, screws, glue, sliding into a socket, or by other means.

In some embodiments, the bristles of the side brush may be of varying lengths and in other embodiments, the bristles of the side brush may all be the same length. In some embodiments, the bristles of the side brush are between 60 to 80 mm in length. In other embodiments, the bristles of the side brush are between 35 to 65 mm in length. Other ranges of lengths greater than 80 mm are also possible.

In some embodiments, the bristles of the side brush are fabricated from nylon, polyester, acrylic, polyolefin, carbon, modacrylic, a combination of such materials, or other materials. In some embodiments, the bristles of the side brush are fabricated from a variety of materials, and, in other embodiments, the bristles of the side brush are all fabricated from the same material.

In some embodiments, the number of bristles in a bundle of the side brush may be between 60 to 80 bristles, between 30 to 70 bristles, or between 100 to 150 bristles. Other ranges are also possible. In some embodiments, each bundle has the same number of bristles, and, in other embodiments, each bundle has a different number of bristles.

In some embodiments, the angle of each bundle of the side brush with respect to a horizontal plane (e.g., driving surface of the robotic cleaner) is between 10 to 30 degrees. In other embodiments, the angle of each bundle may be between 20 to 50 degrees. Other ranges are also possible. In some embodiments, the angle of each bundle with respect to the horizontal plane is different, and, in other embodiments, the angle of each bundle with respect to the horizontal plane is the same.

In some embodiments, the shore A durometer rating (i.e., hardness) of the material used in fabricating the bristles is between 65 to 100. In other embodiments, the shore A durometer rating of the material may be between 80 to 120. Other ranges are also possible. In some embodiments, the bristles of the side brush have the same shore durometer rating, and, in other embodiments, the bristles of the side brush have different shore durometer ratings.

In embodiments, the number of attachment points in the main body and bundles of bristles may vary. All combinations are possible. For example, some side brushes include one bundle of bristles while other side brushes include two, five, seven or any other number of reasonable bundles of bristles.

In some embodiments, the robotic cleaner includes one or more side brushes. In some embodiments, the one or more side brushes are in line with one another. In some embodiments, the robotic cleaner includes any number of side brushes. For example, the robotic cleaner can include one, three, five, or any reasonable number of side brushes. In some embodiments, each side brush is the same and in other embodiments, side brushes have different characteristics.

In some embodiments, normal operation of the side brush includes continuous rotation in one direction. In some embodiments, normal operation of the side brush includes oscillation, wherein the side brush is continuously rotated a predetermined number of degrees (e.g., 30, 45, or 60 degrees) in a first direction then a second direction. Examples of different mechanisms that can be used to oscillate the side brush are provided in U.S. patent application Ser. Nos. 15/924,176 and 62/544,273, the entire contents of which are hereby incorporated by reference.

In some embodiments, wherein the robotic cleaner includes more than one side brush, each side brush can be operated independently. For example, a processor of a robotic cleaner with three side brushes can autonomously choose based on real-time environmental sensor data to power side brush one and power off side brush two and three or can choose to power side brush one and three and power off side brush two. Side brushes are notoriously prone to becoming entangled with objects in the work environment such as cables and cords. In situations where the mobile robotic vacuum encounters an obstacle which poses a threat to the side brush such as a cord or cable, it makes sense for that side brush to cease operation. Further, the use of side brushes utilizes battery power. In situations where the side brushes are not all needed for use in cleaning, any unnecessary side brush cease utilizing power.

The mobile robotic cleaning device may be paired with a control mechanism for controlling the operation and use of the various side brushes. While operating in the work environment, sensors on the mobile robotic cleaning device obtain information pertaining to the work environment. This information is sent to a processor. Thereafter the mobile robotic cleaning device autonomously determines how to operate each side brush. In some embodiments, the mobile robotic cleaning device will utilize sensors arranged around it to sense entangling dangers such as cords and cables in the work environment. As the mobile robotic device approaches said cord or cable, any side brushes at risk of becoming entangled with the cord or cable will cease operation. In such a situation, other side brushes not at risk of entanglement may not cease spinning if they are in operation. In some embodiments, the mobile robotic cleaning device will utilize sensors arranged around it to sense debris in the area. When debris is sensed, the side brush closest to the debris will activate and spin to collect the debris. The side brushes not necessary for collecting this debris may not operate. In some embodiments, the side brushes will not operate until debris is sensed in the area, and then only the side brush closest to the debris will operate. In some embodiments, the speed of a side brush may increase or decrease based on the presence or absence of debris in the work environment. This embodiment is further described in U.S. patent application Ser. Nos. 16/024,263 and 62/527,261, the Entire Contents of which are Hereby incorporated by reference.

In some embodiments, the side brush includes a side brush cover to prevent or reduce interaction with obstructions. An example of a side brush cover is provided in U.S. patent application Ser. Nos. 15/647,472 and 62/364,517, the entire contents of which are hereby incorporated by reference.

Figure 1B:
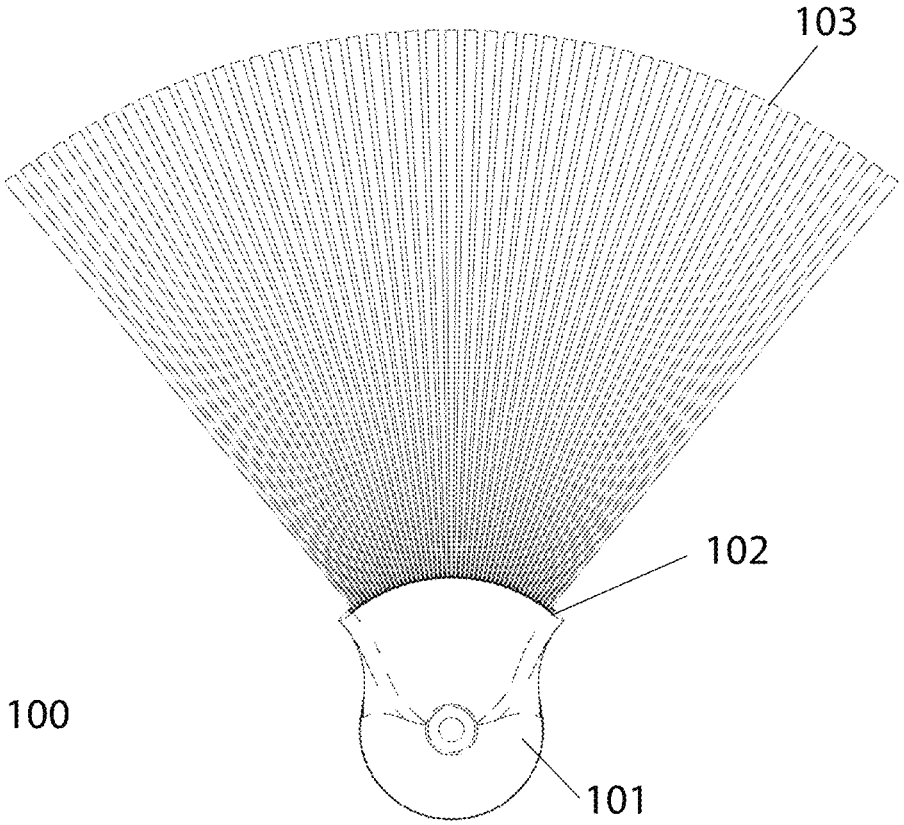

FIGS. 1A and 1B illustrate side and top views of an example of a side brush. Side brush 100 includes main body 101, attachment point 102 of main body 101, and long soft bristles 103 attached to respective attachment points 102 of main body 101.

Figure 2:
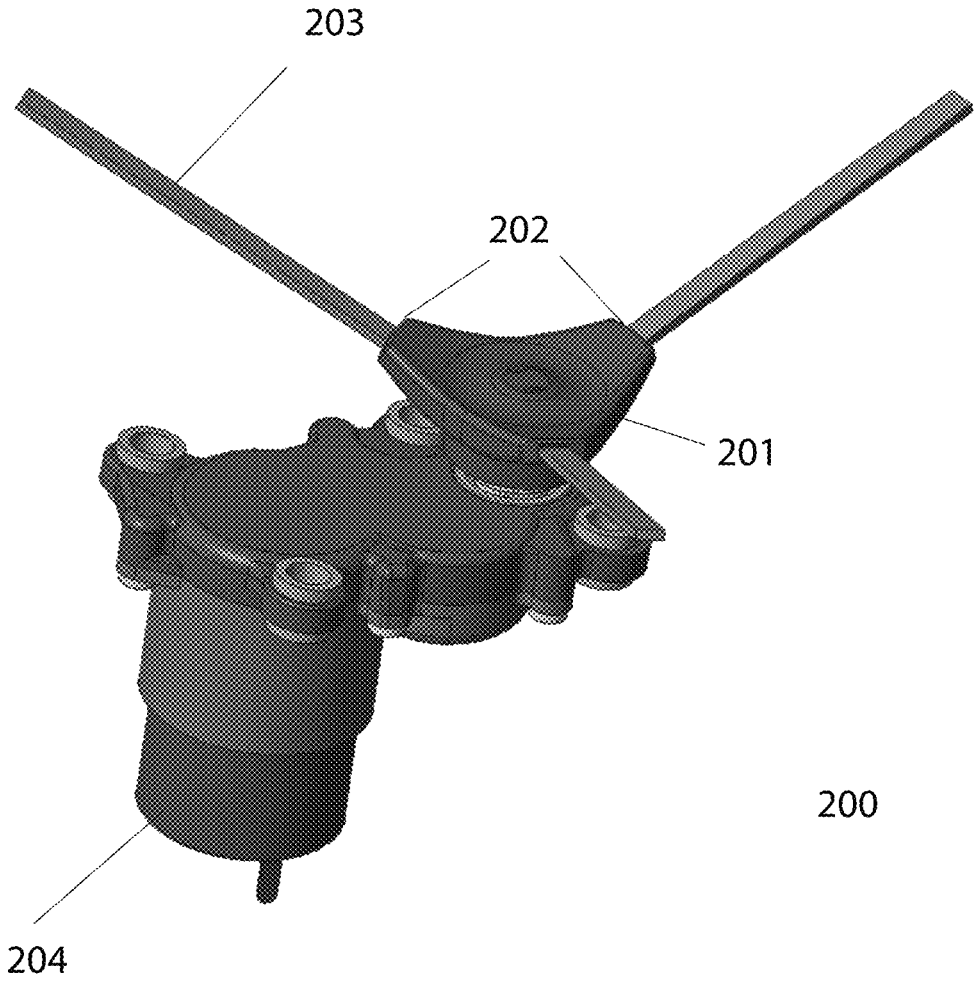
FIG. 2 illustrates an example of a side brush with long soft bristles and attached to a motor, embodying some features of the present inventions.

FIG. 2 illustrates another example of a side brush with an attached motor. Side brush 200 includes main body 201, attachment points 202 of main body 201, and long soft bristles 203 attached to respective attachment points 202 of main body 201. Motor 204 is attached to main body 201 and powers side brush 200.

Figure 3:
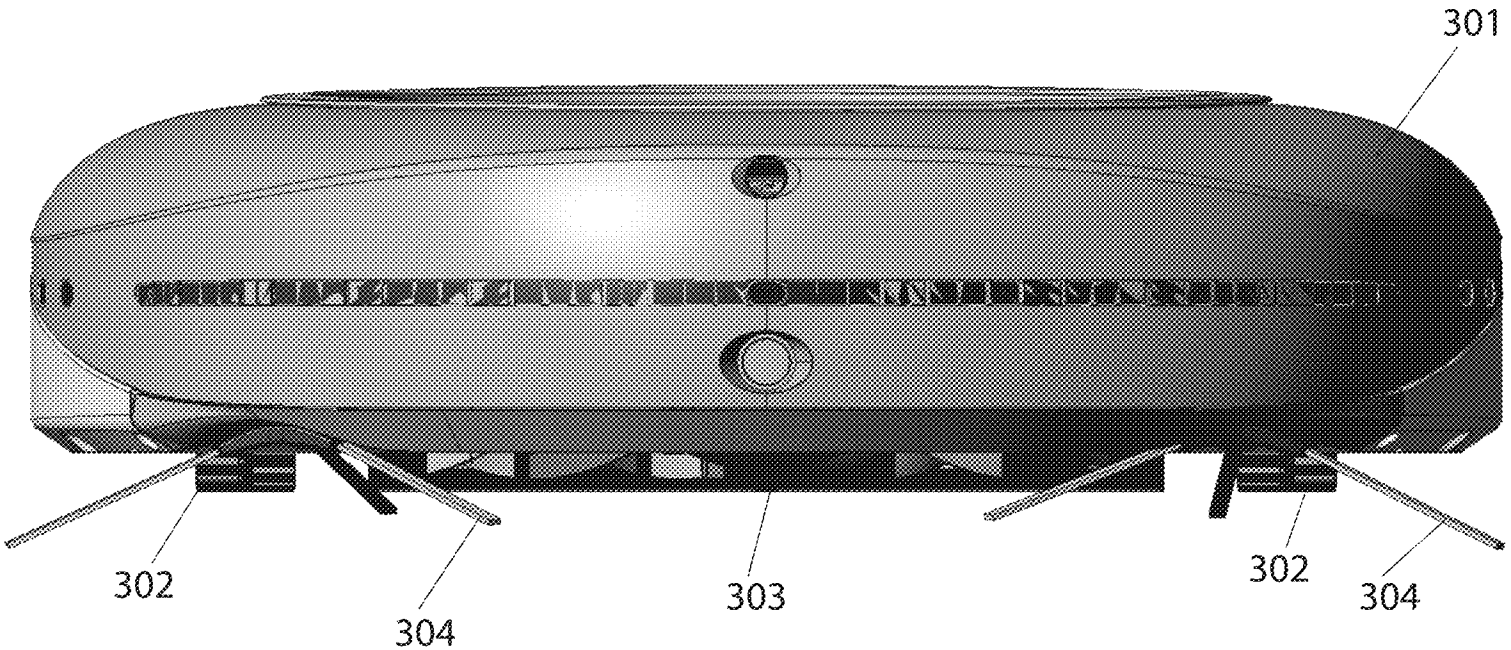
FIG. 3 illustrates an example of a robotic cleaner with side brushes with long soft bristles, embodying some features of the present inventions.

FIG. 3 illustrates an example of a robotic cleaner with side brushes. Robotic cleaner 300 includes, among other components, a chassis 301, wheels 302, a main brush 303, and two side brushes 304 attached to chassis 301.

Figure 4:
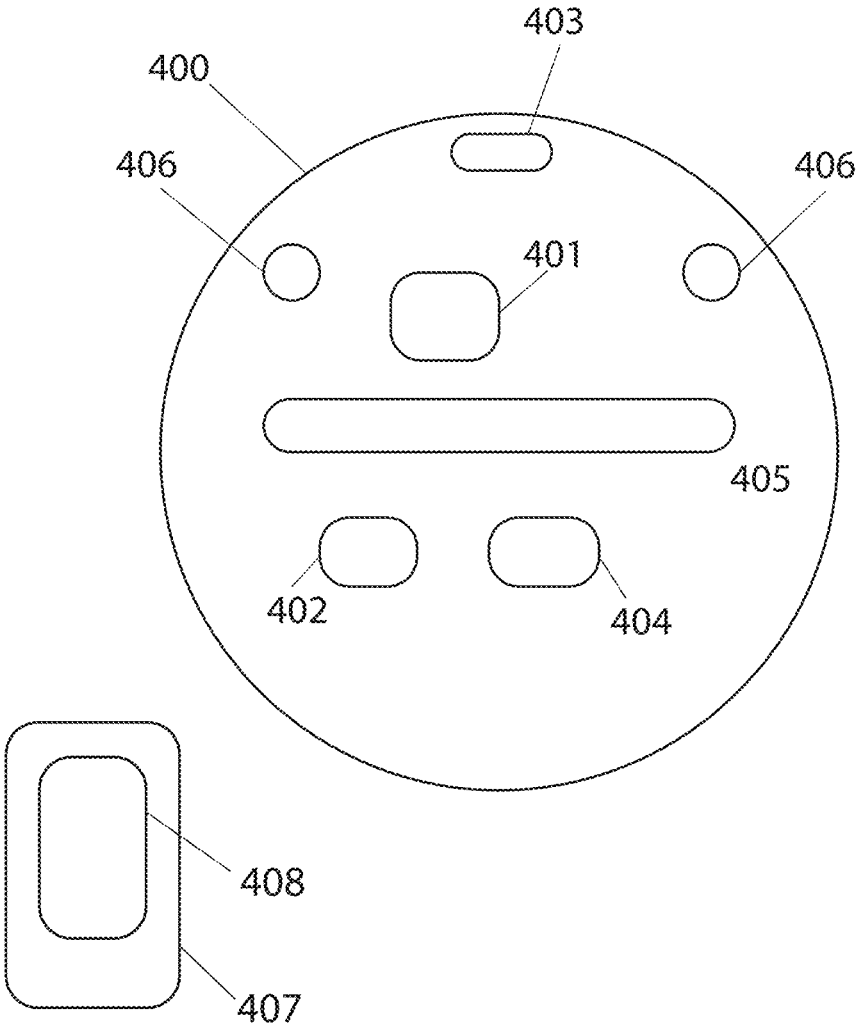
FIG. 4 illustrates an example of a robotic cleaner, embodying some features of the present inventions.

FIG. 4 illustrates an example of a robotic cleaner 400 with a processor 401, memory 402, one or more sensors 403, actuator 404, main brush 405, and side brushes 406. In some embodiments, the robotic cleaner 400 may include the features of a robotic cleaner described herein. In some embodiments, program code stored in the memory 402 and executed by the processor 401 may effectuate the operations described herein. Some embodiments additionally include communication device 407 (e.g., mobile device, laptop, remote control, specialized computer, desktop computer, tablet, etc.) having a touchscreen 408 and that executes an application by which the user interfaces with robotic cleaner 400. In some embodiments, processor 401 and memory 402 implement some of the functionality described herein. In some embodiments, a user may provide instructions to robotic cleaner 400 to perform certain tasks or to use certain settings at certain times or in certain areas of the environment using an application of communication device 407 wirelessly paired with robotic cleaner 400.

Methods for providing user instructions to a robotic device include those described in U.S. patent application Ser. Nos. 15/272,752 and 15/949,708, the entirety of the contents of which are hereby incorporated by reference. In some embodiments, once a map is established, it may be sent to a user interface. Maps may be sent to a user interface at any stage; they do not need to be complete. In some embodiments, through the interface, a user may view the map and take any of a variety of actions. In embodiments, a user interface may be provided through a software application on a computer, tablet, smartphone, or a dedicated remote control. In some embodiments, a user may adjust or correct the map boundaries within the user interface by selecting all or part of a boundary line using a cursor, pointer, stylus, mouse, the user's finger, a button or buttons, or other input device on the user interface. In some embodiments, once a boundary line is selected, a user may be provided with various options, such as, but not limited to, deleting, trimming, rotating, elongating, redrawing, moving in a left direction, moving in a right direction, moving in an upward direction, moving in a downward direction, etc. In some embodiments, a user may be given the option to redraw a boundary line using a cursor, pointer, stylus, mouse, the user's finger, a button or buttons, or other input devices.

In some embodiments, maps generated by robotic devices may contain errors, be incomplete, or simply not reflect the areas that a user wishes a robotic floor-cleaning device to service. By adjusting the map, a user may improve the accuracy of the information that the robotic device has about its environment, thereby improving the device's ability to navigate through the environment. A user may, for example, extend the boundaries of a map in areas where the actual boundaries are further than those identified by the system, or trim boundaries where the system identified boundaries further than the actual or desired boundaries. Even in cases where a system creates an accurate map of an environment, a user may prefer to adjust the map boundaries to keep the device from entering some areas.

In some embodiments, data may be sent between the robotic floor-cleaning device and the user interface through one or more network communication connections. Any type of wireless network signals may be used, including, but not limited to, radio signals, Wi-Fi signals, or Bluetooth signals. In some embodiments, map data collected by sensors of the robotic floor-cleaning device is sent to the user interface, where a user may make adjustments and/or apply or adjust settings. In some embodiments, changes made by a user in the user interface are sent to the robotic floor-cleaning device through the one or more network communication connections.

In some embodiments, robotic floor-cleaning devices may have a plurality of tools that can be used concurrently or independently, such as, but not limited to, a suction tool, a mopping tool, and a UV light for killing bacteria. In some embodiments, robotic floor-cleaning devices may also have various settings, such as a deep cleaning setting, a regular cleaning setting, speed settings, movement pattern settings, cleaning frequency settings, etc. In some embodiments, a user is enabled to adjust all of these settings through the user interface. In some embodiments, a user may select with a cursor, pointer, stylus, mouse, the user's finger, a button or buttons, a keyboard, or other input devices any portion of the workspace and select one or more settings to be applied to the area.

An example of a process for creating a two-dimensional map and utilizing an interactive user interface includes, in a first step, the system collects data about the environment with sensors positioned on the robotic floor-cleaning device. In a next step, the system generates a two-dimensional map of the workspace based on the collected data. As mentioned previously, any available methods may be used to create a two-dimensional map of the environment, including, but not limited to, simultaneous localization and mapping (SLAM) techniques. In some methods, measurement systems, such as LIDAR, are used to measure distances from the robotic device to the nearest obstacle in a 360 degree plane in order to generate a two-dimensional map of the area. In a next step, the two-dimensional map is sent to the user interface via one or more network communication connections. In a next step, the system checks for changes made by a user on the user interface. If any changes are detected (to either the map boundaries or the operation settings), the method proceeds to a next step to send the user changes to the device. If no changes to the map boundaries or the operation settings are detected, the robot proceeds to continue working without any changes.

An example of a process for customizing robotic device operation through a user interface includes, in a first step, a user selects the area of the workspace map in which he or she wants to designate robotic device operation settings. A user may select any size area; the area selected could be comprised of a small portion of the workspace or could encompass the entire workspace. In a next step, a user selects desired settings for the selected area. The particular functions and settings available may be dependent on the capabilities of the particular robotic floor-cleaning device in question. For example, in some embodiments, a user may select any of: cleaning modes, frequency of cleaning, intensity of cleaning, navigation methods, driving speed, etc. In a next step, the selections made by the user are sent to the robotic floor-cleaning device. In a next step, a processor of the robotic floor-cleaning device processes the received data and applies the user changes.

In an exemplary workspace, obstacles may be detected by a robotic floor-cleaning device, such as the walls of the workspace and a piece of furniture. A two-dimensional map may be created by a robotic floor-cleaning device of the workspace. Because the methods for generating the map are not 100% accurate, the two-dimensional map generated is approximate and not perfect. A robotic floor-cleaning device may devise navigation plans based on the generated map, and thus performance may suffer as a result of imperfections in the generated map. A user may desire to correct the boundary lines to match the actual obstacles. Some embodiments include a user-adjusted two-dimensional map. By changing the boundary lines of the map created by the robotic floor-cleaning device, a user is enabled to create a two-dimensional map of the workspace that accurately identifies obstacles and boundaries in the workspace. Furthermore, as discussed previously, a user may identify areas within the two-dimensional map to be treated in specific ways. By delineating a portion of the map, a user may select settings for that area. For example, a user may identify an area and select weekly cleaning, as opposed to daily or standard cleaning, for that area. In a like manner, a user may define an area and turn on a mopping function for that area. A remaining area may be treated in a default manner. Additionally, in adjusting the boundary lines of the two-dimensional map, a user is permitted to create boundaries anywhere desired, regardless of whether an actual boundary exists in the workspace. In an example, a boundary line in a corner may be redrawn to exclude the area near the corner. The robotic floor-cleaning device will thus be prevented from entering the area. This may be useful for keeping a robotic floor-cleaning device out of areas that a user does not want the device to service. For example, a user might exclude areas from a map with fragile objects, pets, cables or wires, etc.

In an example of a user interface, a user may delineate sections of the workspace to be serviced in different ways by the robotic floor-cleaning device. The user may delineate four sections. The user may select the settings of the robotic floor-cleaning device within each section independently of the other sections using the user interface. In the example shown, a user uses his or her finger to manipulate the map through a touchscreen; however, various other methods may be employed depending on the hardware of the device providing the user interface.

Additionally, in some embodiments, a real-time robotic floor-cleaning device manager may be provided on the user interface to allow a user to instruct the real-time operation of the robotic floor-cleaning device regardless of the device's location within the two-dimensional map. In some embodiments, instructions may include any of turning on or off a mop tool, turning on or off a UV light tool, turning on or off a suction tool, turning on or off an automatic shutoff timer, increasing speed, decreasing speed, driving to a user-identified location, turning in a left or right direction, driving forward, driving backward, stopping movement, commencing one or a series of movement patterns, or any other preprogrammed action.

Methods for setting a schedule of a robotic device include those described in U.S. patent application Ser. Nos. 16/051,328 and 15/449,660, the entirety of the contents of which are incorporated herein by reference. For instance, some users may benefit from a robotic floor-cleaning device that operates on a schedule but that does not require the user to take the time or energy to set up the schedule. A method for automatically devising a robotic floor-cleaning device work schedule based on user inputs may be beneficial. Some embodiments provide a schedule development method for a robotic floor-cleaning device that automatically devises a work schedule based on historical data. Some embodiments record user inputs indicating days and times to start work. Some embodiments develop a work schedule for future work based on the recorded inputs. In some embodiments, a control unit of the robotic floor-cleaning device is configured to save a date and time set by a user when the robotic floor-cleaning device should be turned on. In some embodiments, the control unit is further configured to suggest a work schedule based on the saved data to the user using the input/output means.

Some embodiments disclose a method for setting a work schedule for a robotic floor-cleaning device including: monitoring use times of a robotic floor-cleaning device over a preset period of time; storing the times and dates the robotic floor-cleaning device was turned on in a database; developing a suggested work schedule based on the stored data; and proposing the suggested work schedule to users through an input/output device. Some embodiments provide a method including: monitoring use times of a robotic floor-cleaning device over a preset period of time; storing the times and dates the robotic floor-cleaning device was turned on in a database; devising a suggested work schedule from the stored data using a machine learning technique; proposing the suggested work schedule to users through an input/output device; accepting user adjustments to the suggested work schedule through the input/output device; and adding the user adjustment data to the database for use in devising future work schedules. One skilled in the art will appreciate that different embodiments of the invention may use different machine learning techniques such as, but not limited to, supervised learning, unsupervised learning, reinforcement learning, semi-supervised learning, etc.

In some embodiments, the input/output device may be wireless and may send and receive signals to and from remote devices, such as, for example, remote controls and smartphones. In some embodiments, the floor-cleaning device may be scheduled directly via a user interface positioned thereon. In some embodiments, inputs from a user and outputs from the robotic floor-cleaning device may be provided through a software application installed on an internet-connected device, such as a smartphone, a computer, or a tablet. An example of a process for devising a suggested work schedule, according to some embodiments, includes monitoring activation dates and times, storing the dates and times in a database, developing a suggested work schedule based on the stored data, and proposing the suggested work schedule. In some embodiments, the suggested work schedule is developed based on times the robotic-floor cleaning device was turned on as per user-provided instruction. In some embodiments, the times the robotic-floor cleaning device was turned on is stored in a database. In some embodiments, the suggested work schedule is followed by the robotic floor-cleaning device after approval by the user of the suggested work schedule. In some embodiments, the suggested work schedule is developed based on data stored in the most recently updated database, wherein the database is continuously updated with new times the robotic-floor cleaning device was turned on. In some embodiments, the suggested work schedule is developed based on the times the robotic-floor cleaning device was turned on that are stored in the database and using a start time that is the mean or median of the start times in the database, a start time that is the mean or median of a subset of the start times in the database, and/or using a machine learning algorithm to devise a work schedule based on the times in the database.

The robotic cleaner may also include other components and features not shown, such as additional sensors and processors, cameras, odometers, brushes, cleaning tools, etc.

Those skilled in the art will also appreciate that while various items are illustrated as being stored in memory or on storage while being used, these items or portions of them may be transferred between memory and other storage devices for purposes of memory management and data integrity. Alternatively, in other embodiments some or all of the software components may execute in memory on another device and communicate with the computer system of the robotic device via inter-computer communication. Some or all of the system components or data structures may also be stored (e.g., as instructions or structured data) on a computer-accessible medium or a portable article to be read by an appropriate drive. In some embodiments, instructions stored on a computer-accessible medium separate from computer system of the robotic device may be transmitted to computer system of the robotic device via transmission media or signals such as electrical, electromagnetic, or digital signals, conveyed via a communication medium such as a network or a wireless link. Various embodiments may further include receiving, sending, or storing instructions or data implemented in accordance with the foregoing description upon a computer-accessible medium. Accordingly, the present techniques may be practiced with other computer system configurations.

The reader should appreciate that the present application describes several independently useful techniques. Rather than separating those techniques into multiple isolated patent applications, applicants have grouped these techniques into a single document because their related subject matter lends itself to economies in the application process. But the distinct advantages and aspects of such techniques should not be conflated. In some cases, embodiments address all of the deficiencies noted herein, but it should be understood that the techniques are independently useful, and some embodiments address only a subset of such problems or offer other, unmentioned benefits that will be apparent to those of skill in the art reviewing the present disclosure. Due to costs constraints, some techniques disclosed herein may not be presently claimed and may be claimed in later filings, such as continuation applications or by amending the present claims. Similarly, due to space constraints, neither the Abstract nor the Summary sections of the present document should be taken as containing a comprehensive listing of all such techniques or all aspects of such techniques.

It should be understood that the description and the drawings are not intended to limit the present techniques to the particular form disclosed, but to the contrary, the intention is to cover all modifications, equivalents, and alternatives falling within the spirit and scope of the present techniques as defined by the appended claims. Further modifications and alternative embodiments of various aspects of the techniques will be apparent to those skilled in the art in view of this description. Accordingly, this description and the drawings are to be construed as illustrative only and are for the purpose of teaching those skilled in the art the general manner of carrying out the present techniques. It is to be understood that the forms of the present techniques shown and described herein are to be taken as examples of embodiments. Elements and materials may be substituted for those illustrated and described herein, parts and processes may be reversed or omitted, and certain features of the present techniques may be utilized independently, all as would be apparent to one skilled in the art after having the benefit of this description of the present techniques. Changes may be made in the elements described herein without departing from the spirit and scope of the present techniques as described in the following claims. Headings used herein are for organizational purposes only and are not meant to be used to limit the scope of the description.

As used throughout this application, the word "may" is used in a permissive sense (i.e., meaning having the potential to), rather than the mandatory sense (i.e., meaning must). The words "include", "including", and "includes" and the like mean including, but not limited to. As used throughout this application, the singular forms "a," "an," and "the" include plural referents unless the content explicitly indicates otherwise. Thus, for example, reference to "an element" or "a element" includes a combination of two or more elements, notwithstanding use of other terms and phrases for one or more elements, such as "one or more." The term "or" is, unless indicated otherwise, non-exclusive, i.e., encompassing both "and" and "or." Terms describing conditional relationships, e.g., "in response to X, Y," "upon X, Y,", "if X, Y," "when X, Y," and the like, encompass causal relationships in which the antecedent is a necessary causal condition, the antecedent is a sufficient causal condition, or the antecedent is a contributory causal condition of the consequent, e.g., "state X occurs upon condition Y obtaining" is generic to "X occurs solely upon Y" and "X occurs upon Y and Z." Such conditional relationships are not limited to consequences that instantly follow the antecedent obtaining, as some consequences may be delayed, and in conditional statements, antecedents are connected to their consequents, e.g., the antecedent is relevant to the likelihood of the consequent occurring. Statements in which a plurality of attributes or functions are mapped to a plurality of objects (e.g., one or more processors performing steps A, B, C, and D) encompasses both all such attributes or functions being mapped to all such objects and subsets of the attributes or functions being mapped to subsets of the attributes or functions (e.g., both all processors each performing steps A-D, and a case in which processor 1 performs step A, processor 2 performs step B and part of step C, and processor 3 performs part of step C and step D), unless otherwise indicated. Further, unless otherwise indicated, statements that one value or action is "based on" another condition or value encompass both instances in which the condition or value is the sole factor and instances in which the condition or value is one factor among a plurality of factors. Unless otherwise indicated, statements that "each" instance of some collection have some property should not be read to exclude cases where some otherwise identical or similar members of a larger collection do not have the property, i.e., each does not necessarily mean each and every. Limitations as to sequence of recited steps should not be read into the claims unless explicitly specified, e.g., with explicit language like "after performing X, performing Y," in contrast to statements that might be improperly argued to imply sequence limitations, like "performing X on items, performing Y on the X' ed items," used for purposes of making claims more readable rather than specifying sequence. Statements referring to "at least Z of A, B, and C," and the like (e.g., "at least Z of A, B, or C"), refer to at least Z of the listed categories (A, B, and C) and do not require at least Z units in each category. Unless specifically stated otherwise, as apparent from the discussion, it is appreciated that throughout this specification discussions utilizing terms such as "processing," "computing," "calculating," "determining" or the like refer to actions or processes of a specific apparatus, such as a special purpose computer or a similar special purpose electronic processing/computing device. Features described with reference to geometric constructs, like "parallel," "perpendicular/orthogonal," "square", "cylindrical," and the like, should be construed as encompassing items that substantially embody the properties of the geometric construct, e.g., reference to "parallel" surfaces encompasses substantially parallel surfaces. The permitted range of deviation from Platonic ideals of these geometric constructs is to be determined with reference to ranges in the specification, and where such ranges are not stated, with reference to industry norms in the field of use, and where such ranges are not defined, with reference to industry norms in the field of manufacturing of the designated feature, and where such ranges are not defined, features substantially embodying a geometric construct should be construed to include those features within 15% of the defining attributes of that geometric construct.

The invention claimed is:

1. A method for cleaning a workspace by a robot, comprising:

capturing, with at least one sensor disposed on the robot, data indicative of locations of objects in a workspace through which the robot moves;

generating or updating, with a processor of the robot, a map of at least a part of the workspace based on at least the data;

navigating, with the processor, the robot based on the map or an updated map of the workspace;

displaying, with a software application executed on a user computing device paired with the robot, each of: the map, a status of the robot, a battery level of the robot, and progress statistics of a robotic operation in execution or executed by the robot; and receiving, with the software application, at least one input designating each of: a cleaning schedule, a subarea of the workspace, a name for the subarea of the workspace, the robotic operation to be executed by the robot within at least one area of the workspace or the entire workspace, and settings to be applied within at least one subarea of the workspace or the entire workspace;

wherein:

the robot comprises at least one brush; and the robotic operation comprises at least one of: mopping and vacuuming.

2. The method of claim 1, further comprising:

receiving, with the software application, the at least one input further designating: a modification, a deletion, or an addition of a boundary.

3. The method of claim 1, wherein:

the settings comprise at least a cleaning intensity; and the cleaning intensity comprises a suction power level.

4. The method of claim 1, further comprising:

receiving, with the software application, the at least one input further designating: a specific location within the map to which the robot is to drive to perform work; and actuating, with the processor, the robot to execute the instruction.

5. The method of claim 1, further comprising:

receiving, with the software application, the at least one input further designating: a modification to the map indicating an area within the workspace the robot is to avoid.

6. The method of claim 1, further comprising:

receiving, with the software application, the at least one input further designating: an instruction for the robot to rotate in a first direction, rotate in a second direction, drive in a forward direction, or drive in a backward direction; and actuating, with the processor, the robot to execute the instruction.

7. The method of claim 1, further comprising:

determining, with the processor, a brush setting of a brush of the robot based on sensor data indicative of a characteristic of the environment.

8. The method of claim 1, wherein the at least one sensor comprises a LIDAR.

9. The method of claim 1, further comprising:

actuating, with the processor, the robot to clean according to a suggested cleaning schedule, wherein the processor only actuates the robot to clean according to the suggested schedule after approval of the suggested schedule;

proposing, with the software application, the suggested cleaning schedule for operating the robot comprising at least one day and time to a user; and receiving, with the software application, the at least one input further designating: an approval of the suggested schedule.

10. The method of claim 9, wherein the suggested schedule is inferred using a machine learning algorithm.

11. The method of claim 9, wherein at least a plurality of inputs historically provided to the software application are used to infer the suggested schedule.

12. The method of claim 11, wherein the plurality of inputs designates a plurality of schedules previously executed by the robot at a particular past day and time specified in each of the plurality of schedules.

13. The method of claim 1, wherein the at least one brush comprises:

a main body with at least one attachment point; and at least one bundle of bristles attached to the at least one attachment point of the main body, wherein the at least one attachment point of the main body is provided at an end of at least one protrusion of the main body.

14. A system for cleaning a workspace by a robot, comprising:

a robot, comprising:

at least one brush;

at least one sensor;

a processor; and computer-readable memory storing instructions that when executed by the processor effectuates operations comprising:

capturing, with the at least one sensor, data indicative of locations of objects in a workspace through which the robot moves;

generating or updating, with the processor, a map of at least a part of the workspace based on at least the data; and navigating, with the processor, the robot based on the map or an updated map of the workspace; and a software application executed on a user computing device paired with the robot configured to:

display each of: the map, a status of the robot, a battery level of the robot, and progress statistics of a robotic operation in execution or executed by the robot; and receive at least one input designating each of: a subarea of the workspace, a name for the subarea of the workspace, the robotic operation to be executed by the robot within at least one area of the workspace or the entire workspace, settings to be applied within at least one subarea of the workspace or the entire workspace, and a modification to the map indicating an area within the workspace the robot is to avoid;

wherein:

the robotic operation comprises at least one of: mopping and vacuuming;

the settings comprise at least a cleaning intensity; and the cleaning intensity comprises a suction power level.

15. The system of claim 14, wherein the software application is further configured to receive the at least one input further designating: a modification, a deletion, or an addition of a boundary.

16. The system of claim 14, wherein:

the software application is further configured to receive the at least one input further designating: a specific location within the map to which the robot is to drive to perform work; and the operations further comprise:

actuating, with the processor, the robot to execute the instruction.

17. The system of claim 14, wherein:

the software application is further configured to receive the at least one input further designating: an instruction for the robot to rotate in a first direction, rotate in a second direction, drive in a forward direction, or drive in a backward direction; and the operations further comprise:

actuating, with the processor, the robot to execute the instruction.

18. The system of claim 14, wherein the operations further comprise:

determining, with the processor, a brush setting of a brush of the robot based on sensor data indicative of a characteristic of the environment.

19. The system of claim 14, wherein:

the operations further comprise:

actuating, with the processor, the robot to clean according to a suggested cleaning schedule, wherein the processor only actuates the robot to clean according to the suggested schedule after approval of the suggested schedule;

the software application is configured to propose the suggested cleaning schedule for operating the robot comprising at least one day and time to a user;

the software application is further configured to receive the at least one input further designating: an approval of the suggested schedule; and the suggested schedule is inferred based on cleaning habits of the user.

20. The system of claim 14, wherein the at least one brush comprises:

a main body with at least one attachment point; and at least one bundle of bristles attached to the at least one attachment point of the main body, wherein the at least one attachment point of the main body is provided at an end of at least one protrusion of the main body.

* * * * *